US008740569B2

(12) United States Patent
Bruhn et al.

(10) Patent No.: US 8,740,569 B2
(45) Date of Patent: Jun. 3, 2014

(54) IMPELLER FOR A CENTRIFUGAL PUMP

(75) Inventors: Aage Bruhn, Bjerringbro (DK); Lars Ostergaard, Randers NV (DK)

(73) Assignee: Grundfos Management a/s, Bjerringbro (DK)

( * ) Notice: Subject to any disclaimer, the term of this patent is extended or adjusted under 35 U.S.C. 154(b) by 945 days.

(21) Appl. No.: 12/714,626

(22) Filed: Mar. 1, 2010

(65) Prior Publication Data

US 2010/0226773 A1 Sep. 9, 2010

(30) Foreign Application Priority Data

Mar. 9, 2009 (EP) ..... 09 003 369

(51) Int. Cl.
*F04D 29/22* (2006.01)

(52) U.S. Cl.
USPC ..... 416/223 R

(58) Field of Classification Search
USPC ..... 416/179
See application file for complete search history.

(56) References Cited

U.S. PATENT DOCUMENTS

| | | | | |
|---|---|---|---|---|
| 436,015 | A * | 9/1890 | Currier et al. | 416/179 |
| 538,050 | A * | 4/1895 | Swabel | 415/227 |
| 1,947,658 | A * | 2/1934 | Pizzuto | 416/182 |
| 3,362,338 | A | 1/1968 | Stethem | |
| 2003/0002985 | A1 * | 1/2003 | Tsui | 416/186 R |
| 2005/0242015 | A1 * | 11/2005 | Curtis et al. | 210/195.1 |

FOREIGN PATENT DOCUMENTS

| | | | |
|---|---|---|---|
| DE | 4139293 | A1 | 6/1993 |
| GB | 2168764 | A | 6/1986 |
| GB | 2260788 | A | 4/1993 |

OTHER PUBLICATIONS

Office Action issued Aug. 5, 2013 in CN Application No. 201010128895.9.

* cited by examiner

*Primary Examiner* — Nathaniel Wiehe
*Assistant Examiner* — Jeffrey A Brownson
(74) *Attorney, Agent, or Firm* — Panitch Schwarze Belisario & Nadel LLP

(57) ABSTRACT

The impeller for a centrifugal pump includes a carrier disk and possibly a shroud. The blades of the impeller are identical, but are arranged in pairs such that impellers of different hydraulic characteristics are formed with blades of the same shape.

9 Claims, 3 Drawing Sheets

(Prior Art)

(Prior Art)

IMPELLER FOR A CENTRIFUGAL PUMP

BACKGROUND OF THE INVENTION

The present invention relates to an impeller for a centrifugal pump.

Impellers for a centrifugal pump typically include at least a carrier body, typically of a carrier disk, and blades arranged thereon. The carrier disk is thereby regularly designed for the rotationally fixed arrangement on a shaft. The impeller blades, depending on the construction type, lie exposed (open impeller) or covered by a shroud, which lies opposite the carrier disk and is connected to the blades. The impellers are known in different construction forms and are applied in single-stage or multistage centrifugal pumps. The impellers typically comprise two or more impeller blades, which may be designed and/or arranged in an equal manner or also in a differing manner.

For example, the impeller represented in FIG. 1 comprises a circular carrier disk 1, which comprises a central recess 2, which is profiled and is envisaged for the rotationally fixed connection to a drive shaft (not shown), as is counted as belonging to the state of the art with centrifugal pumps. A multitude of impeller blades 3 is arranged on the carrier disk 1, which extend at a distance to the recess 2, up to the outer periphery of the carrier disk 1. The blades 3 on the side lying opposite the carrier disk 1 are covered by a shroud 4, which in the embodiment according to FIG. 1 runs out on the inner side into an annular section 5 which forms the run-in of the impeller, as is known per se and is therefore not described in detail.

The shape and the arrangement of the blades 3 may be recognized with a removed shroud 4, as is shown by way of example in FIG. 2. The impeller according to FIG. 2 as a whole comprises six blades 3, which have the same shape and size, and are arranged at the same angular distance on the carrier disk 1.

With impellers formed of plastic, which are manufactured with the injection molding method, as a rule a separate tool is required for each change on the impeller. However, blades of a different arrangement and size may be provided on an impeller, without increasing the manufacturing costs. If, however, the impeller, as is the case with a multitude of centrifugal pumps, is formed of sheet metal, typically of stainless steel sheet metal, then different tools are required for different blade shapes, which increases the manufacturing costs. The manufacture itself is effected by way of aligning the individual blades on the carrier disk and these being welding to this, whereupon, as the case may be, the shroud is applied and likewise welded to the blades.

In order to be able to cover a multitude of application cases, centrifugal pumps are offered in different constructional sizes. The size variation is, however, not only varied by way of changing the geometric dimensions and the drive power, but also by way of variation of the blades. If an impeller, for example, which delivers a certain delivery rate at a given pressure, is to be designed with regard to a reduced delivery rate, then for example the blade height may be reduced accordingly. However, natural limits are placed on this, since a minimum passage height must be retained within the impeller in order to ensure fault-free operation. With cast impellers, it is counted as belonging to the state of the art to fill out intermediate spaces between blade pairs in order to reduce the delivery rate. With impellers manufactured of sheet metal, this is not possible, or only with an increased expense by way of arranging two blades for forming a dead space. However a separate punching tool is necessary for each of these impellers.

BRIEF SUMMARY OF THE INVENTION

Against this background, it is the object of the present invention to create an impeller variance, i.e. impellers with different delivery characteristics, which is very favorable with regard to manufacturing technology, and which may be manufactured as inexpensively as possible, in particular of sheet metal.

According to the present invention, the above objective is achieved by an impeller with the features specified in claim 1. Advantageous designs of the invention are specified in the dependent claims, the subsequent description and the drawing.

The impeller according to the present invention for a centrifugal pump comprises a carrier disk with blades arranged thereon, with which blades are arranged in pairs next to one another, and at least the blades forming one blade pair have the same shape and size.

The basic concept of the present invention is to provide at least one, and preferably several, blade pairs on the impeller, which in each case are arranged next to one another and have the same shape and size. Thereby, these blades in the end product preferably have the same shape and size. However, according to the present invention, it is also conceivable to use these blades of the same shape and size only in an intermediate step, and as the case may be to change the shape and/or size in a further machining step. The main concept is, however, to reduce the variance of the blade shape, such that the number of tools for manufacturing the blades may be reduced and moreover the feed of the blades in the manufacturing process and their handling is simplified. Thereby, advantageously the shape and the size of such blade pairs is identical, for example they have the same dimensions and the same radii of curvature.

According to the present invention a blade pair forms a flow-effective blade. Thus hydraulically differently effective blades may be formed on the impeller alone by way of the arrangement of the impellers, with two impellers of the same shape. Thereby, the shape of the blades of such a blade pair according to the present invention is typically designed as is applied with a normal impeller. The variance which may be achieved according to the present invention by way of the paired arrangement of equally shaped impellers is then used for special purposes.

Thus, for example, for increasing the length of a blade, according to the present invention, such a lengthened blade may be formed by way of two blades of a blade pair, which are applied onto one another in a telescopic manner. Such a lengthened blade may, for example, be applied for a carrier disk of a larger diameter, if an impeller is to be designed for achieving a larger delivery height.

As explained initially by way of example, in practice, it often occurs that an impeller is to be designed for producing a smaller delivery rate. Then, according to the present invention, a blade pair consisting of two blades of the same shape and size may be arranged and aligned such that with regard to flow technology, a dead space forms therebetween, if specifically the radial inner end of a blade bears on the other blade and the radially outer ends are distanced. It is to be understood that a required multitude of such impeller pairs may be arranged on a carrier disk and that the dead space formed in such a manner is particularly effective if the impeller has a covering shroud.

Basically, such a dead space may also be formed in a different manner by a blade pair of blades of the same shape and size, if, for example, the radially outer ends bear on one another and the inner ends are distanced, which however as a rule would tend to be less favorable.

Basically, the present invention may be applied with impellers which are open or covered, and is particularly advantageous with impellers with a covering shroud.

According to a further design of the present invention, the blades of a blade pair may be positioned in a manner such that a blade of the blade pair projects radially beyond the carrier disk and/or the shroud. Hydraulically differently effective blades result by way of this, wherein as the case may be, the projecting ends may be removed in a further manufacturing step, or left as they are.

With regard to manufacturing technology, it is particularly advantageous if all blades have the same shape and size, since then one only requires one tool for manufacturing the blades.

In particular for impellers with a shroud, an impeller blade is advantageously dimensioned such that it has a constant height over its entire length. This is particularly advantageous for the paired arrangement, since in this manner one may create particularly good dead spaces, or one may form longer blades.

The present invention is especially advantageously applicable to impellers which are manufactured of sheet metal, with which therefore the carrier disk and/or shroud, as well as the blades, are formed of sheet metal and are connected to one another by way of welding. The present invention is, however, not so limited. It may also advantageously be applied to impellers of other materials, for example, of plastics or composite materials, in particular if the carrier disk, shroud and blades are manufactured independently of one another and then joined.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
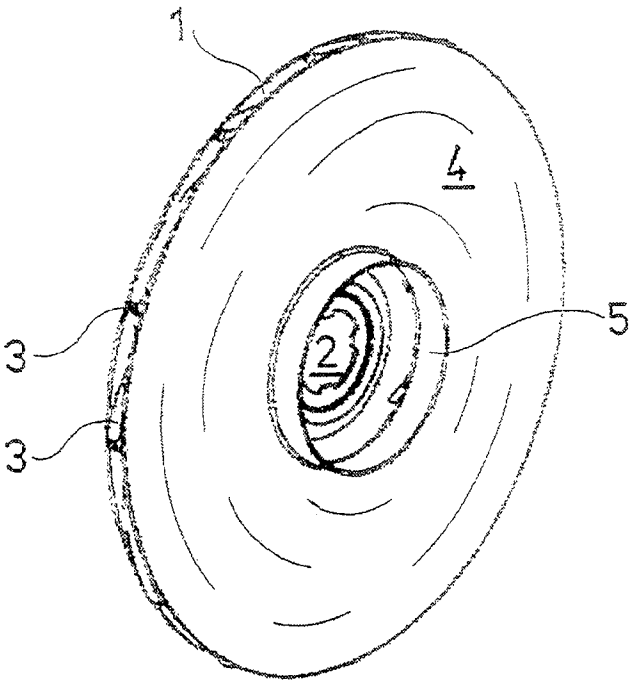
FIG. 1 is a greatly simplified schematic perspective view of a centrifugal pump impeller of the prior art.
Figure 3:
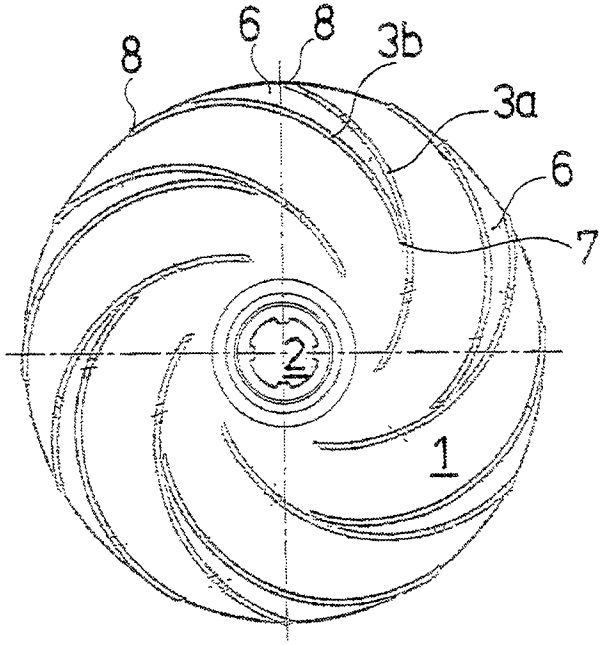
FIG. 3 is a plan view of an impeller shown without a shroud in accordance with a first preferred embodiment of the present invention.
Figure 2:
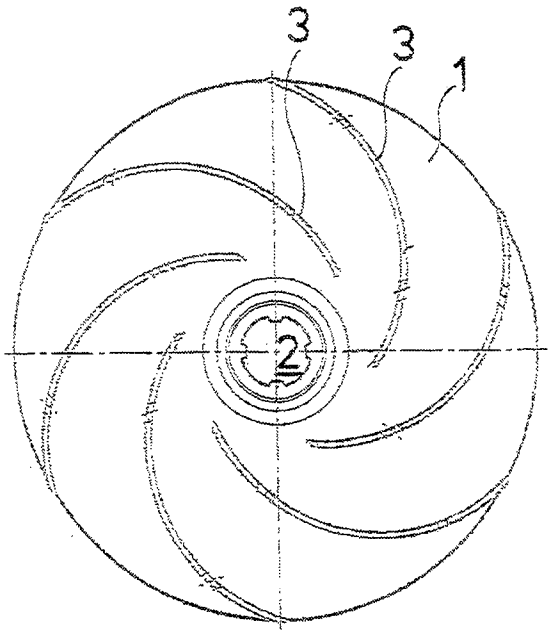
FIG. 2 is a plan view of an impeller of the prior art shown without a shroud.

Referring to the drawings in detail, wherein like numerals indicate like elements throughout, FIG. 3 shows an impeller without a shroud in accordance with a first preferred embodiment of the present invention. The impeller according to FIG. 3, which delivers lower delivery rates than impellers of the prior art (i.e., FIGS. 1 and 2), includes two blades 3*a*, 3*b* that are arranged into an impeller pair, such that hydraulically, a dead space 6 is formed between them. The blades 3*a*, 3*b* are of the same shape and size, and thus have the same material thickness, the same length, the same height and the same radius of curvature. The blades 3*a*, 3*b* are, however, arranged in a different manner. The first blades 3*a* of the impeller pair are arranged in the same manner as those with the impeller according to FIG. 2. However, additionally to the blades 3 of FIG. 2 and the first blades 3*a* of FIG. 3, the second blades 3*b* of the impeller pair of FIG. 3 are arranged specifically such that a radially inner end 7 of each second blade 3*b* bears on the inner side of a respective first blade 3*a*, while radially outer ends 8 of each blades 3*a*, 3*b* are spaced a predetermined distance apart.

Figure 4:
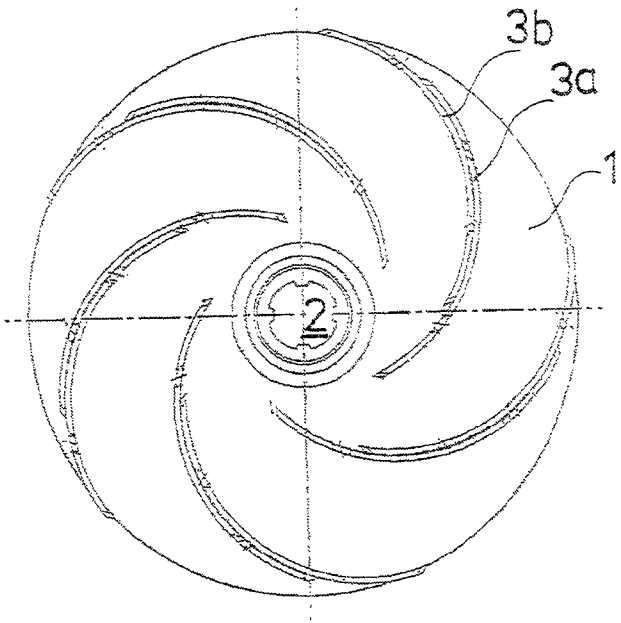
FIG. 4 is a plan view of an impeller shown without a shroud in accordance with a second preferred embodiment of the present invention.

FIG. 4 shows an impeller without a shroud in accordance with a second preferred embodiment of the present invention. In the embodiment according to FIG. 4, six impeller pairs in each case consisting of the blades 3*a*, 3*b* are arranged on a carrier disk 1. However, the combined blades 3*a*, 3*b* do not form a dead space as in the first preferred embodiment of FIG. 3, but form longer blades. Thereby, in each case the blades 3*a*, 3*b* in the second preferred embodiment are applied onto one another in a paired manner and are pulled apart telescopically, such that in comparison to the individual blades 3*a*, 3*b* of each blade pair, a single, hydraulically effective blade of a greater length results.

Figure 5:
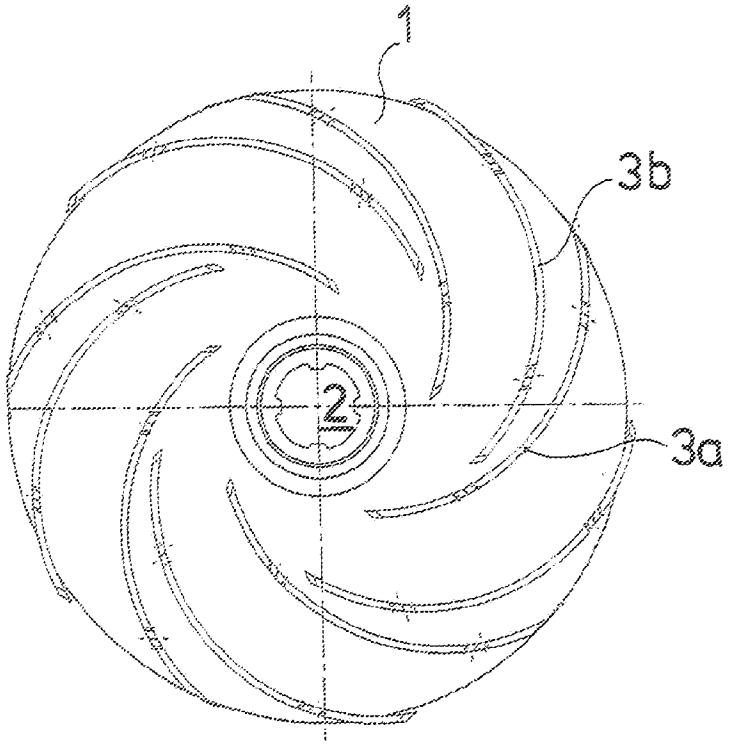
FIG. 5 is a plan view of an impeller shown without a shroud in accordance with a third preferred embodiment of the present invention.

FIG. 5 shows an impeller without a shroud in accordance with a third preferred embodiment of the present invention. In the third embodiment according to FIG. 5, likewise six blade pairs in each case consisting of the blades 3*a*, 3*b* are arranged on a carrier disk 1. However, the first blade 3*a* of each impeller pair is arranged radial further to the inside, so that their radially outer ends terminate with the outer periphery of the carrier disk 1, whereas the outer end of each second blade 3*b* of each impeller pair projects beyond this outer periphery. Moreover, the blades 3*a*, 3*b* are arranged at a different angle to one another.

In all previously described embodiment examples, the blades 3*a*, 3*b* arranged in pairs on the carrier disk 1 are identical in shape and size, such that they have the same length, the same height and the same radius of curvature. In this manner, one may manufacture impellers of different hydraulic characteristics while using components of the same shape, which is advantageous since one and the same punching tool may be applied for the blades 3 or 3*a*, 3*b*. It is to be understood that this is not absolutely necessary. One may arrange different blade pairs or further different blades on an impeller also while using the paired arrangement of equally shaped blades 3*a*, 3*b*, if this is advantageous or useful.

Figure 6:
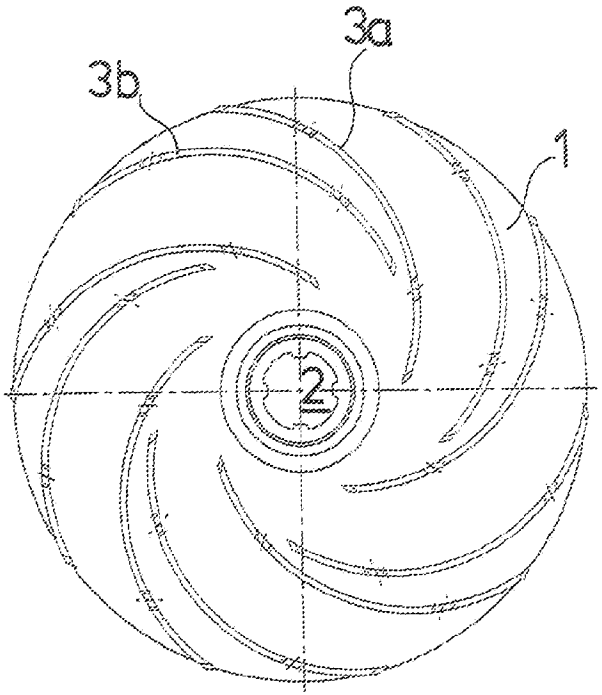
FIG. 6 is a plan view of a modified version of the impeller shown in FIG. 5.

The impeller which has been represented and previously discussed with regard to FIG. 5, as the case may be, may be machined in a further machining step, in a manner such that the projecting ends of the blades 3*b* are removed. The blade pairs which then result, as shown in FIG. 6, consisting of the blades 3*b*' and 3*a* are then no longer equal in shape and size after this machining step.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. An impeller for a centrifugal pump having a carrier disk (1) and blades (3) arranged thereon, the blades (3) being arranged next to one another in pairs, whereas in each case a blade pair forms a flow-effective blade (3*a*, 3*b*), wherein at least the blades (3*a*, 3*b*) forming the blade pair have the same shape and size, and wherein at least a radial end of one of the blades forming the blade pair bears on a surface of the other of the blades forming the blade pair.

2. An impeller according to claim 1, wherein the blades (3*a*, 3*b*) of each blade pair bear on one another in a telescopic manner.

3. An impeller according to claim 1, wherein the blades 3*a*, 3*b*) of each blade pair form a dead space (6).

4. An impeller according to claim 3, wherein the blades (3*a*, 3*b*) of each blade pair which form a dead space (6) are distanced at their radially outer ends (8) and the radially inner end (7) of the one blade (3*b*) bears on the other blade (3*a*).

5. An impeller according to claim 1, wherein a shroud (4) covers the impeller.

6. An impeller according to claim 5, wherein the blades (3*a*, 3*b*) of each blade pair are positioned in a manner such that one blade (3*b*) of the blade pair projects radially beyond the carrier disk (1) and/or the shroud (4).

7. An impeller according to claim 1, wherein all blades (3*a*, 3*b*) have the same shape and size.

8. An impeller according to claim 1, wherein the blade (3) has a constant height over its radial length.

9. An impeller according to claim 1, wherein the carrier disk (1) and/or shroud (4) and the blades (3) are formed of metal and are connected to one another by way of welding.

* * * * *